US008371123B2

(12) United States Patent
Stewart et al.

(10) Patent No.: US 8,371,123 B2
(45) Date of Patent: Feb. 12, 2013

(54) APPARATUS FOR CONDITIONING AIRFLOW THROUGH A NOZZLE

(75) Inventors: Jason Thurman Stewart, Greer, SC (US); Jonathan Dwight Berry, Simpsonville, SC (US); Michael John Hughes, Greer, SC (US)

(73) Assignee: General Electric Company, Schenectady, NY (US)

( * ) Notice: Subject to any disclaimer, the term of this patent is extended or adjusted under 35 U.S.C. 154(b) by 689 days.

(21) Appl. No.: 12/607,386

(22) Filed: Oct. 28, 2009

(65) Prior Publication Data

US 2011/0094232 A1 Apr. 28, 2011

(51) Int. Cl.
*F02C 1/00* (2006.01)

(52) U.S. Cl. ..... 60/737; 60/748

(58) Field of Classification Search ..... 60/734, 60/737, 740, 742, 746–748, 760; 239/399, 239/403

See application file for complete search history.

(56) References Cited

U.S. PATENT DOCUMENTS

| | | | | |
|---|---|---|---|---|
| 5,417,070 | A * | 5/1995 | Richardson | 60/748 |
| 6,438,961 | B2 | 8/2002 | Tuthill et al. | |
| 6,634,175 | B1 | 10/2003 | Kawata et al. | |
| 7,770,395 | B2 * | 8/2010 | Tanimura et al. | 60/737 |
| 2007/0277530 | A1 | 12/2007 | Dinu et al. | |
| 2010/0132364 | A1 | 6/2010 | Myers et al. | |
| 2010/0275605 | A1 * | 11/2010 | Hase et al. | 60/748 |

* cited by examiner

*Primary Examiner* — Phutthiwat Wongwian

(74) *Attorney, Agent, or Firm* — Dority & Manning, P.A.

(57) ABSTRACT

A nozzle includes a center body and a shroud surrounding the center body to define an annular passage. An arcuate annular guide extending from a point radially inward of the shroud to a point radially outward of the shroud defines a first airflow between the arcuate annular guide and the shroud and a second airflow between the arcuate annular guide and the center body.

20 Claims, 10 Drawing Sheets

APPARATUS FOR CONDITIONING AIRFLOW THROUGH A NOZZLE

FIELD OF THE INVENTION

The present invention generally involves an apparatus for conditioning the flow of air to a nozzle. In particular, the present invention divides the flow of air entering a nozzle to improve the radial distribution of the air entering the nozzle.

BACKGROUND OF THE INVENTION

Gas turbines are widely used in commercial operations for power generation. A typical gas turbine includes a compressor at the front, one or more combustors around the middle, and a turbine at the rear. The compressor and the turbine typically share a common rotor. The compressor progressively compresses a working fluid and discharges the working fluid to the combustors. The combustors inject fuel into the flow of compressed working fluid and ignite the mixture to produce combustion gases having a high temperature, pressure, and velocity. The combustion gases exit the combustors and flow to the turbine where they expand to produce work.

FIG. 1 provides a simplified cross-section of a combustor 10 known in the art. A casing 12 surrounds the combustor 10 to contain the compressed working fluid from a compressor (not shown). Nozzles 14 are arranged in an end cover 15 and an end cap 16, and a liner 18 downstream of the nozzles 14 defines a combustion chamber 20. A flow sleeve 22 surrounding the liner 18 defines an annular passage 24 between the flow sleeve 22 and the liner 18. The compressed working fluid flows through the annular passage 24 toward the end cover 15 where it reverses direction to flow through the nozzles 14 into the combustion chamber 20.

Ideally, the mass flow of the compressed working fluid inside the nozzles 14 is radially and circumferentially uniform. A uniform mass flow of compressed working fluid inside the nozzles 14 allows for a uniform distribution of fuel ports inside the nozzles 14 to evenly mix fuel with the compressed working fluid, thus providing a uniform fuel-air mixture for combustion.

Various nozzles have been designed to enhance the radial and/or circumferential distribution of compressed working fluid entering the nozzle. For example, FIG. 2 shows a cross-section of a prior art nozzle 26 with a bellmouth 28 opening. Fuel enters the nozzle 26 through a center body 30 that extends along an axial centerline 32 of the nozzle 26. A shroud 34 circumferentially surrounds a portion of the center body 30 to define an annular passage 36 between the center body 30 and the shroud 34. Swirler vanes 38 in the annular passage 36 may include fuel ports that mix fuel with the compressed working fluid flowing over the swirler vanes 38.

The bellmouth 28 shape increases the size of the opening leading to the annular passage 36, provides a smooth surface over which the compressed working fluid flows, and does not create a large pressure drop for the compressed working fluid entering the annular passage 36. However, computational fluid dynamic models of nozzles having a bellmouth 28 opening indicate that the mass flow rate of the compressed working fluid is concentrated around the center body 30 and diminished radially outward, particularly at the inside of the shroud 34.

FIG. 3 shows another prior art nozzle 40 having an inlet flow conditioner 42. The inlet flow conditioner 42 generally includes one or more baffles 44 and a perforated screen 46. Compressed working fluid flows through the perforated screen 46, and the baffles 44 redirect the airflow to improve the radial distribution of the compressed working fluid inside the nozzle 40. However, the inlet flow conditioner 42 shown in FIG. 3 is more expensive to manufacture and more difficult to assemble than existing nozzles. In addition, the inlet flow conditioner 42 increases the pressure drop of the working fluid as it passes through the nozzle 40.

Therefore the need exists for an improved nozzle design that can radially distribute the compressed working fluid entering the nozzle. Ideally, the improved nozzle design will enhance the radial and/or circumferential distribution of the airflow, not create a large pressure drop for the compressed working fluid, and will be relatively easy to manufacture and install in existing nozzle designs.

BRIEF DESCRIPTION OF THE INVENTION

Aspects and advantages of the invention are set forth below in the following description, or may be obvious from the description, or may be learned through practice of the invention.

One embodiment of the present invention is a fuel nozzle that includes a center body and a shroud circumferentially surrounding at least a portion of the center body to define an annular passage between the center body and the shroud, wherein the shroud includes an end. The fuel nozzle further includes an arcuate annular guide separated from the end of the shroud and extending from a point radially inward of the end of the shroud to a point radially outward of the end of the shroud. The arcuate annular guide defines a first airflow between the arcuate annular guide and the end of the shroud and a second airflow between the arcuate annular guide and the center body.

An alternate embodiment of the present invention is a combustor. The combustor includes an end cap and a nozzle disposed in the end cap. The nozzle includes a center body and a shroud circumferentially surrounding at least a portion of the center body to define an annular passage between the center body and the shroud, wherein the shroud includes an end. The nozzle further includes an arcuate annular guide separated from the end of the shroud and extending from a point radially inward of the end of the shroud to a point radially outward of the end of the shroud. The arcuate annular guide defines a first airflow between the arcuate annular guide and the end of the shroud and a second airflow between the arcuate annular guide and the center body.

In another embodiment of the present invention, a fuel nozzle includes a shroud, wherein the shroud defines a passage and includes an end. The fuel nozzle further includes an arcuate annular guide separated from the end of the shroud and extending from a point radially inward of the end of the shroud to a point radially outward of the end of the shroud. The arcuate annular guide defines a first airflow between the arcuate annular guide and the end of the shroud and a second airflow radially inward of the arcuate annular guide.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
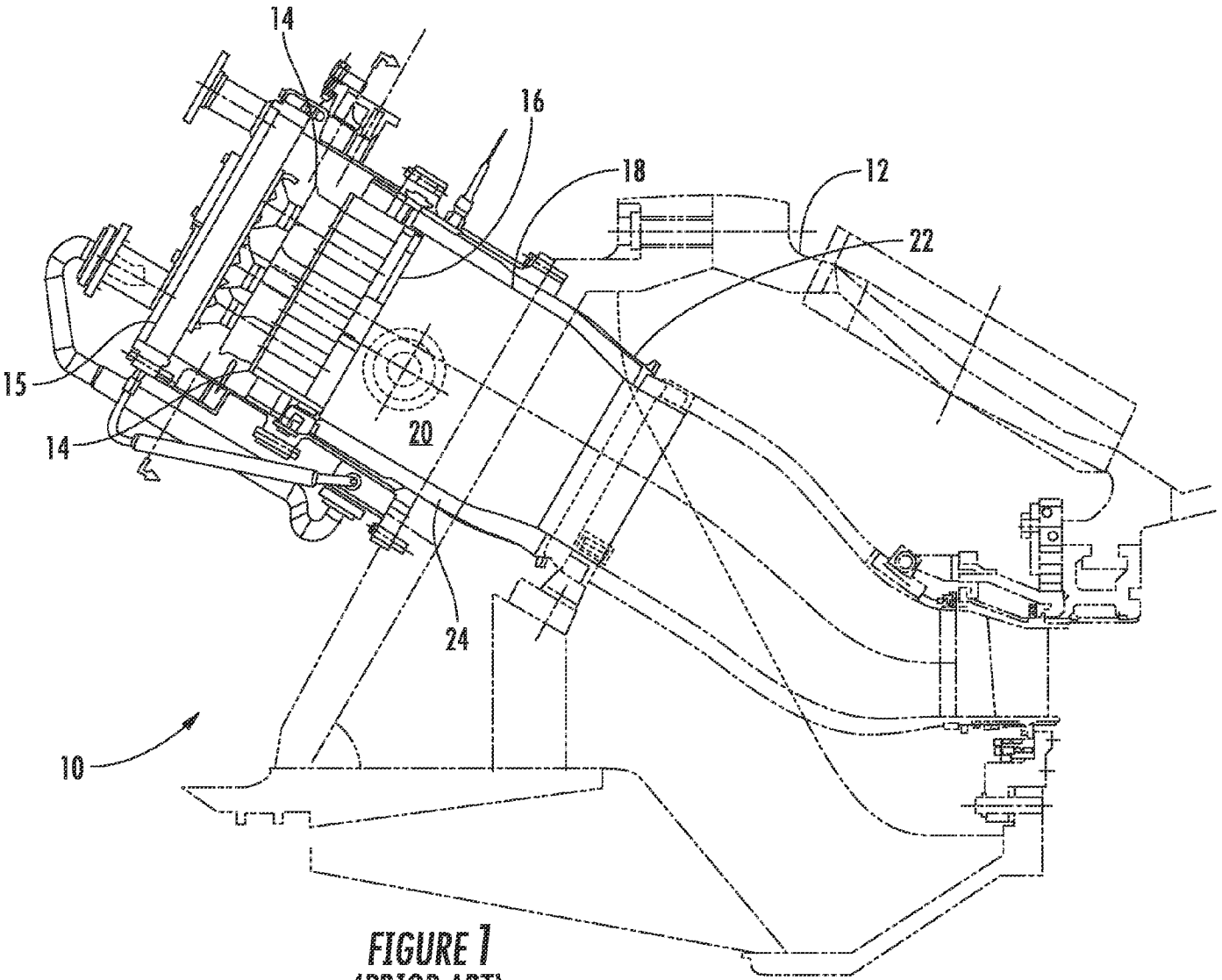
FIGURE 1 (PRIOR ART)
FIG. 1 is a simplified cross-section of a combustor known in the art.
Figure 2:
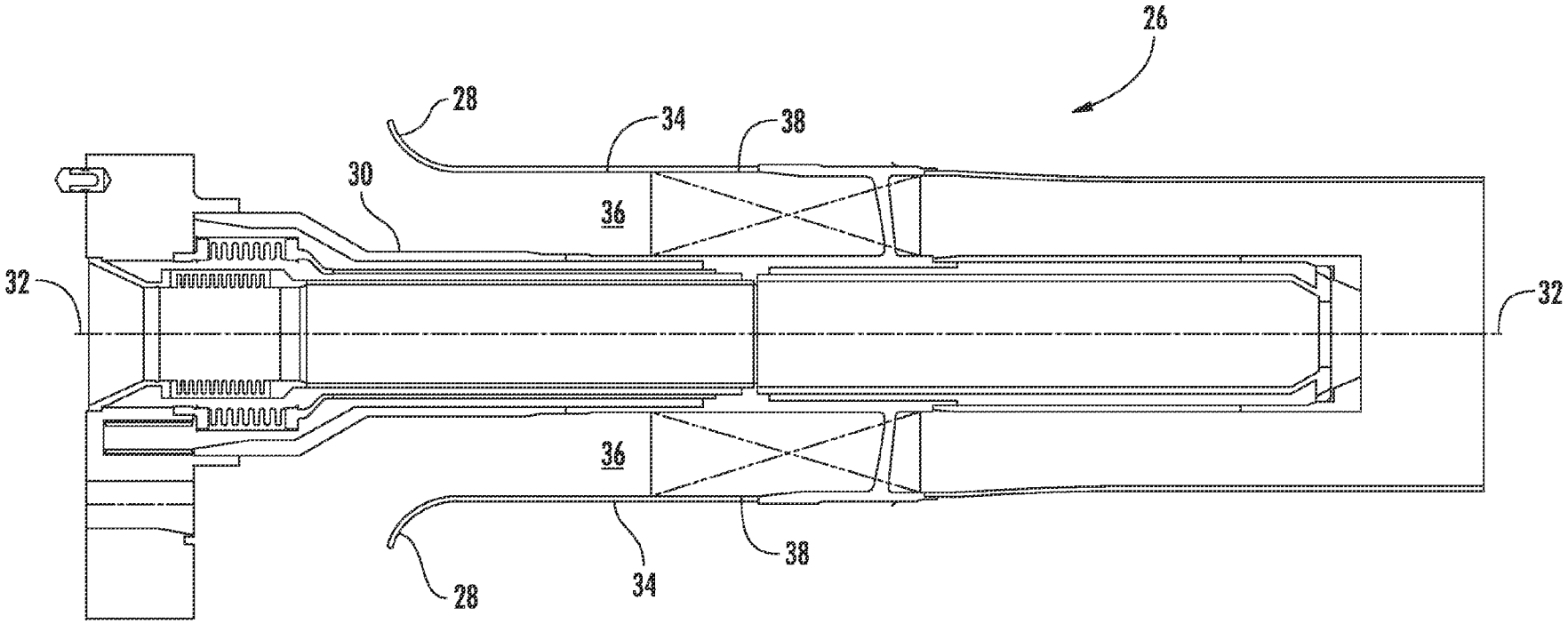
FIGURE 2 (PRIOR ART)
FIG. 2 is a cross-section of a prior art nozzle with a bellmouth opening.
Figure 3:
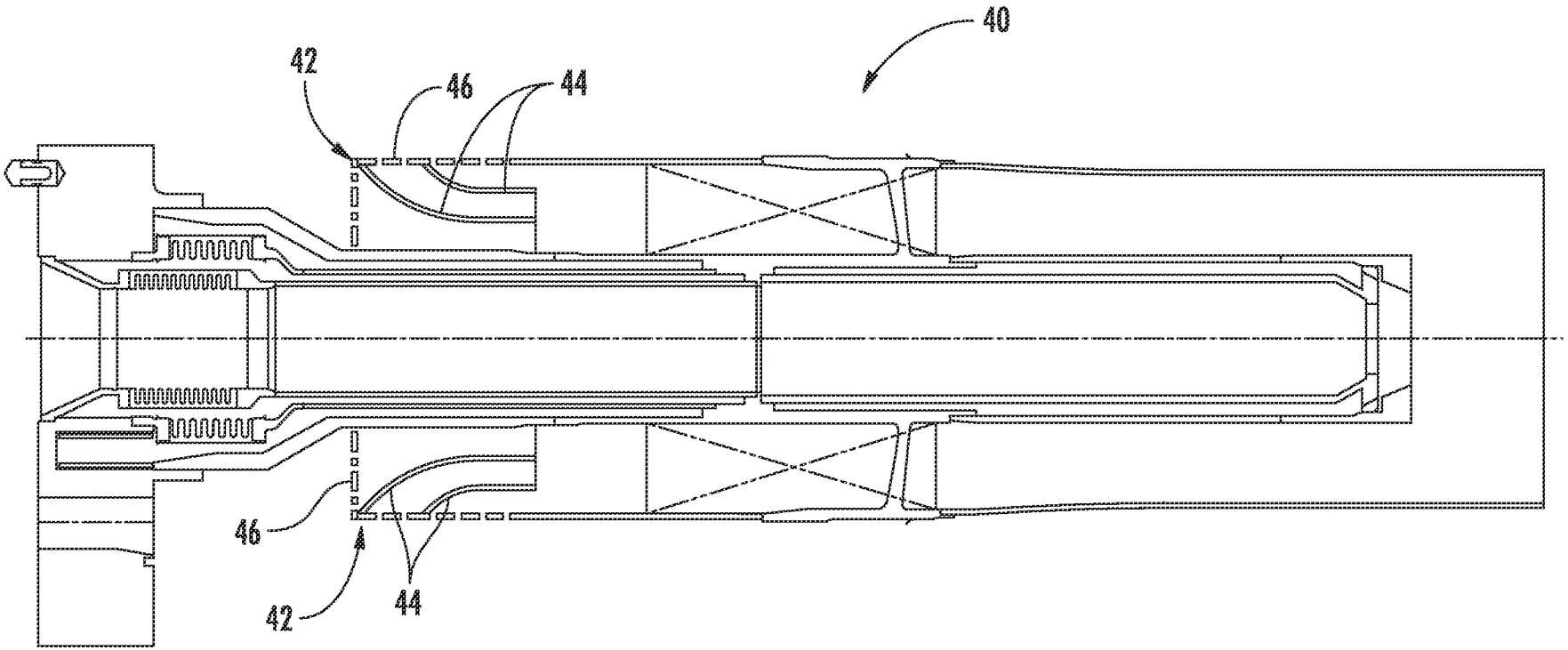
FIGURE 3 (PRIOR ART)
FIG. 3 is another prior art nozzle having an inlet flow conditioner.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 4:
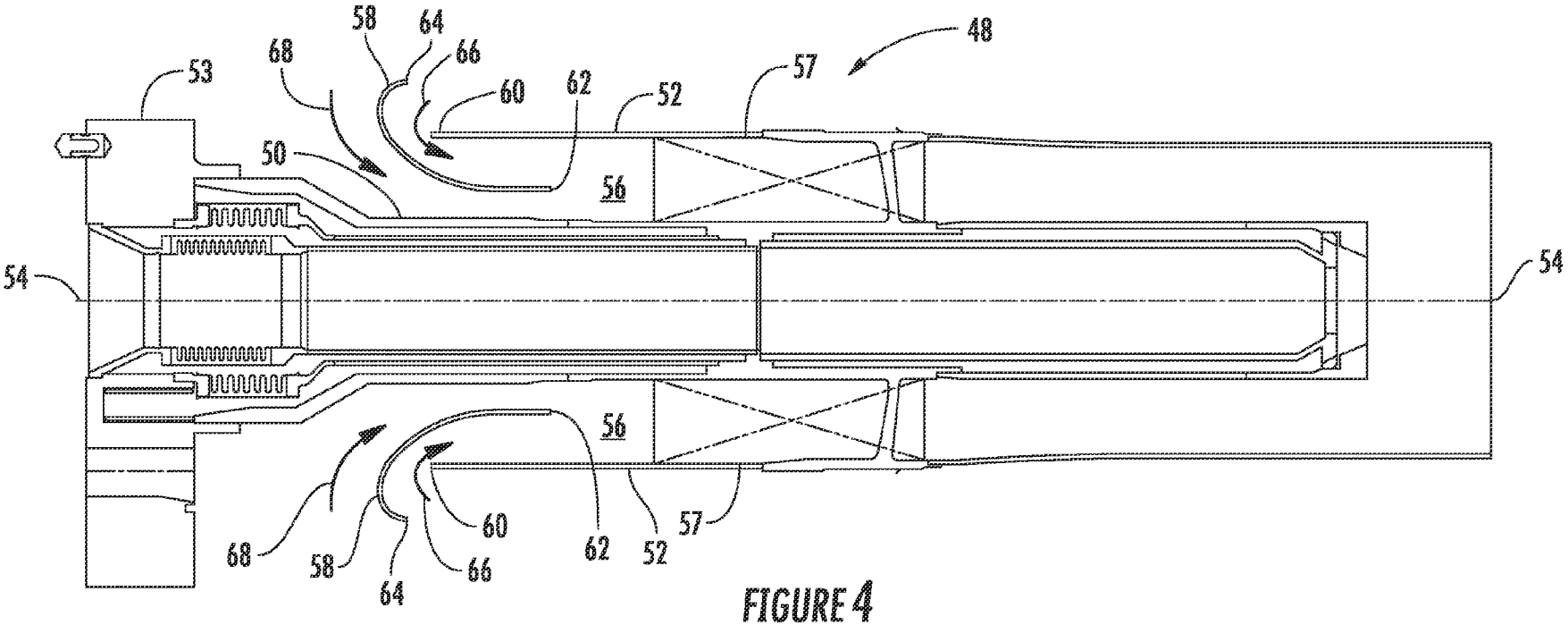
FIG. 4 is a simplified cross-section of a nozzle according to one embodiment of the present invention.

FIG. 4 shows a simplified cross-section of a nozzle 48 according to one embodiment of the present invention. The nozzle 48 generally includes a center body 50 and a shroud 52, although alternate embodiments within the scope of the present invention may include a shroud 52 without a center body 50. The center body 50, if present, connects at one end to a nozzle flange 53 and extends along an axial centerline 54 of the nozzle 48. The shroud 52 circumferentially surrounds at least a portion of the center body 50 to define an annular passage 56 between the center body 50 and the shroud 52. Fuel may be supplied to the center body 50 and injected into the annular passage 56 to mix with the compressed working fluid prior to entry into the combustion chamber. If the center body 50 is not present, the shroud 52 may define an annular passage 56 within the circumference of the shroud 52, and fuel may be supplied through swirler vanes 57.

The nozzle 48 further includes an arcuate annular guide 58 near an end 60 of the shroud 52. The arcuate annular guide 58 extends circumferentially around the opening to the annular passage 56 between the center body 50 and the shroud 52. The arcuate annular guide 58 extends from a point 62 radially inward of the end 60 of the shroud 52 to a point 64 radially outward of the end 60 of the shroud 52. As a result, the arcuate annular guide 58 divides the flow of compressed working fluid entering the annular passage 56 into a first airflow 66 and a second airflow 68. The first airflow 66 is between the arcuate annular guide 58 and the end 60 of the shroud 52, and the second airflow 68 is between the arcuate annular guide 58 and the center body 50. If the center body 50 is not present, the second airflow is radially inward of the arcuate annular guide 58.

Figure 5:
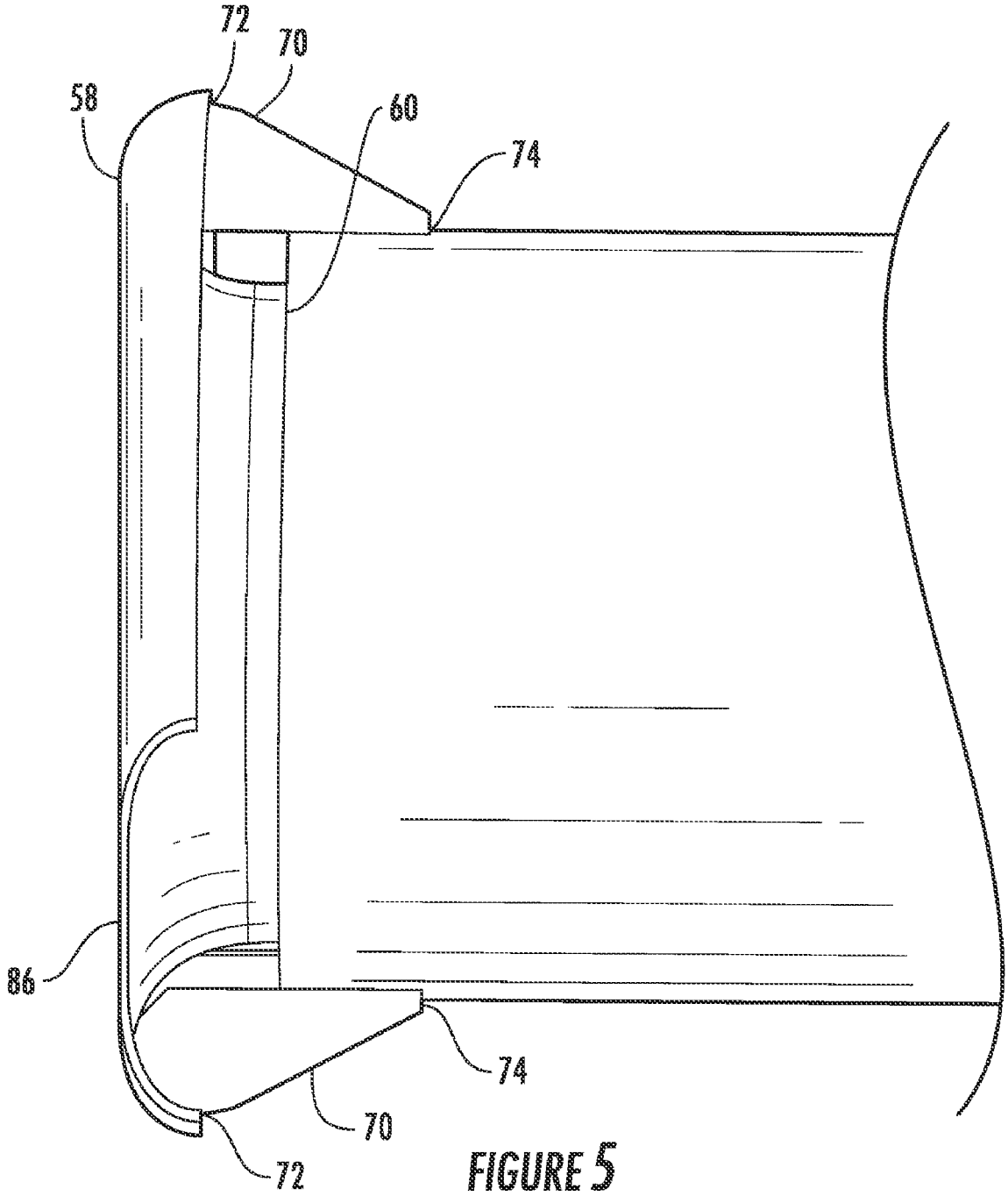
FIG. 5 is a plan drawing of the arcuate annular guide and shroud shown in FIG. 4.

FIG. 5 shows a plan drawing of the arcuate annular guide 58 and shroud 52 shown in FIG. 4. As shown in FIG. 5, one or more struts 70 hold the arcuate annular guide 58 in place. A first end 72 of each strut 70 connects to the arcuate annular guide 58, and a second end 74 of each strut 70 connects to the shroud 52 so that the arcuate annular guide 58 is held in position separate from the end 60 of the shroud 52. In alternate embodiments, the struts 70 may connect to the end cover 15, end cap 16, center body 50, nozzle flange 53, or other suitable structure for holding the arcuate annular guide 58 in place.

Figure 6:
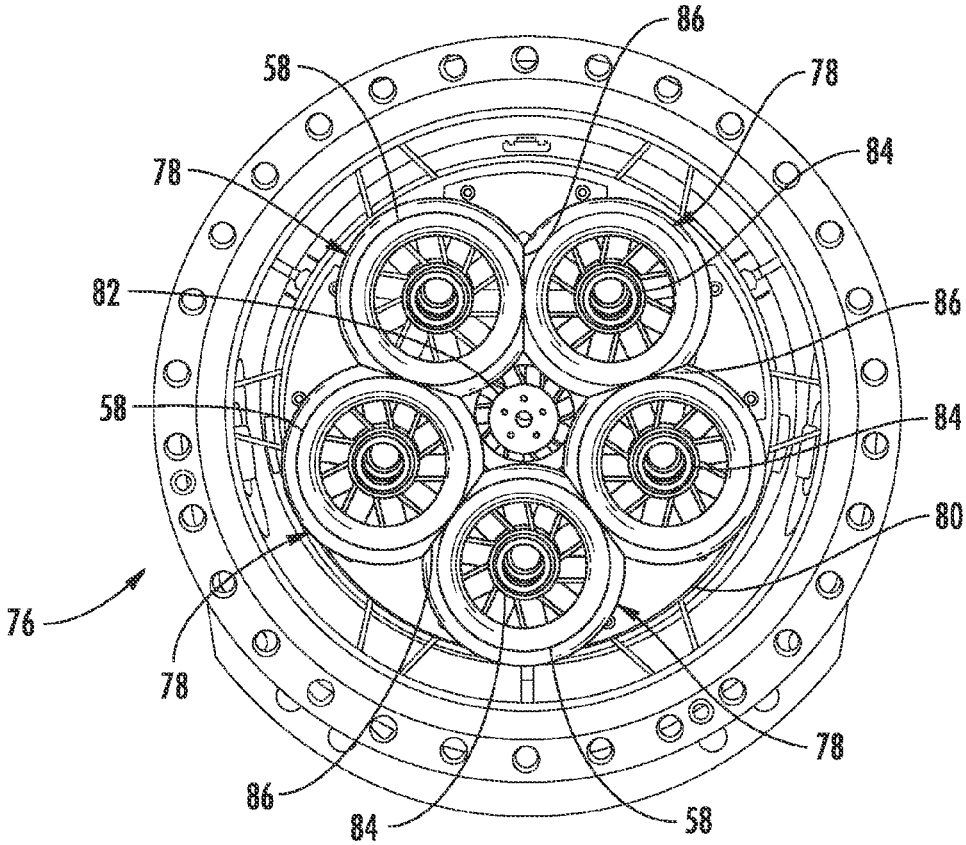
FIG. 6 is a plan drawing of a combustor within the scope of the present invention.
Figure 7:
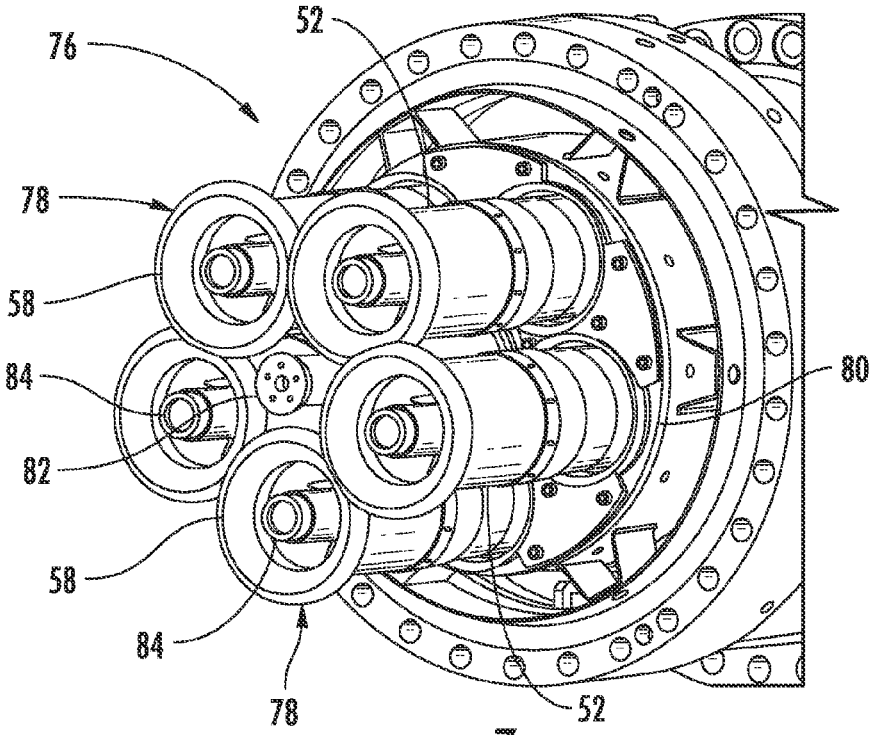
FIG. 7 is a perspective view of the combustor shown in FIG. 6.

FIGS. 6 and 7 show plan and perspective views, respectively, of a combustor 76 within the scope of the present invention. The combustor 76 includes at least one nozzle 78 arranged in an end cap 80. For example, the combustor 76 may include five nozzles 78 radially arranged around a center nozzle 82, as shown in FIGS. 6 and 7. Each nozzle 78 includes a center body 84 with an axial centerline (not shown).

As shown in FIGS. 5 and 6, the arcuate annular guide 58 may include a perimeter with a substantially flat segment 86 along at least a portion of the perimeter. The substantially flat segments 86 allow adjacent nozzles 78 to be radially arranged within the end cap 80 without requiring any overlapping of the nozzles 78 or the associated arcuate annular guides 58.

Figure 8:
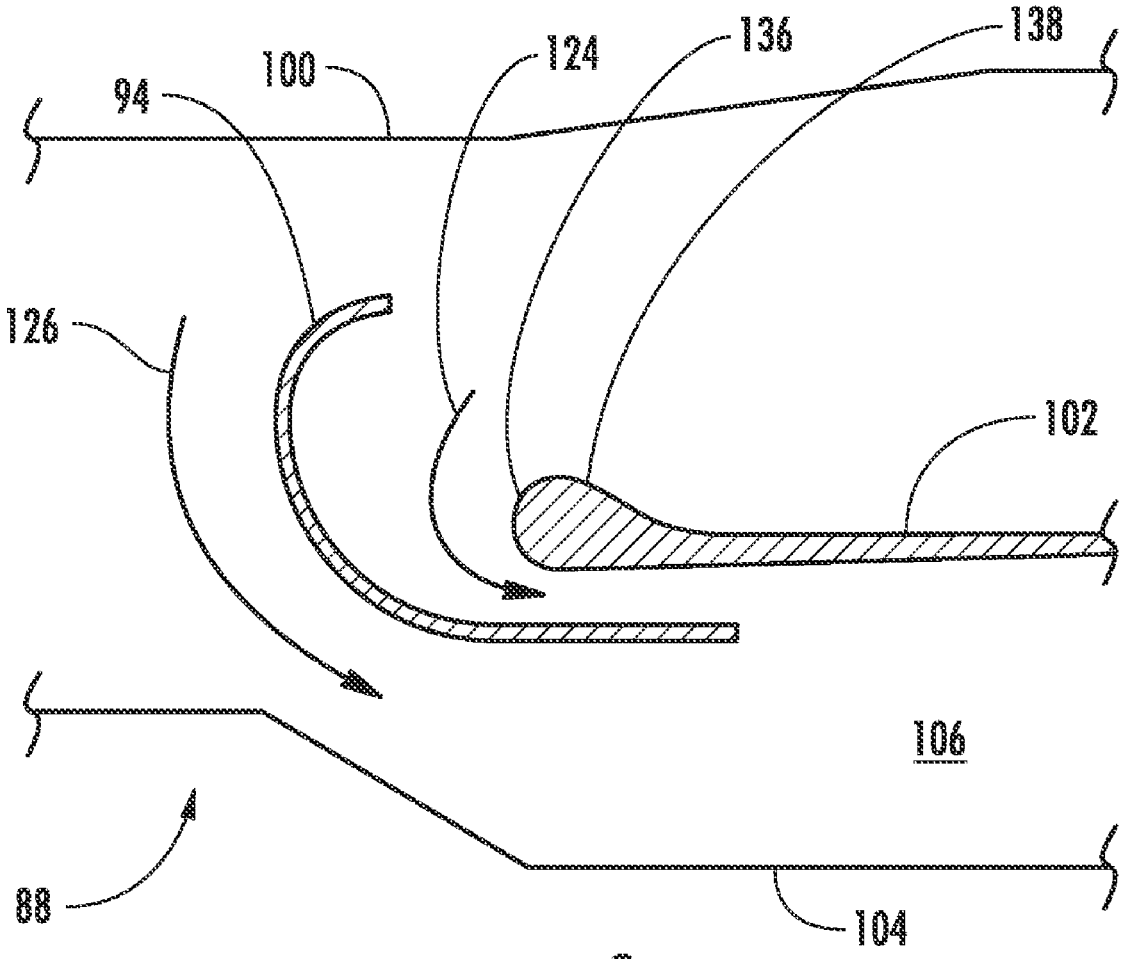
FIG. 8 is a simplified, partial cross-section of a second embodiment of a nozzle within the scope of the present invention.
Figure 9:
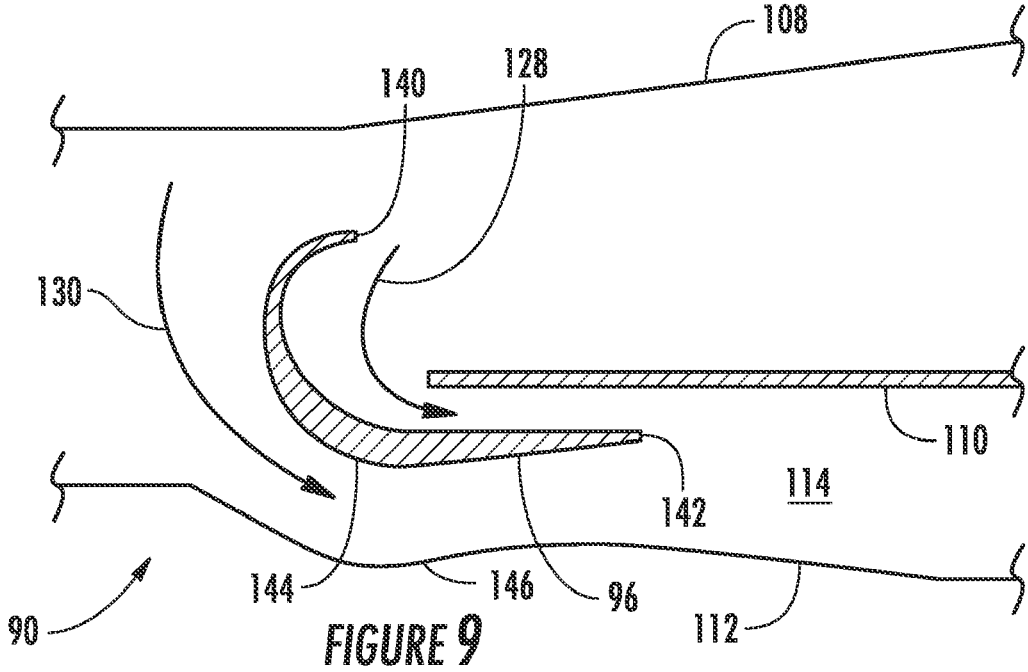
FIG. 9 is a simplified, partial cross-section of a third embodiment of a nozzle within the scope of the present invention.
Figure 10:
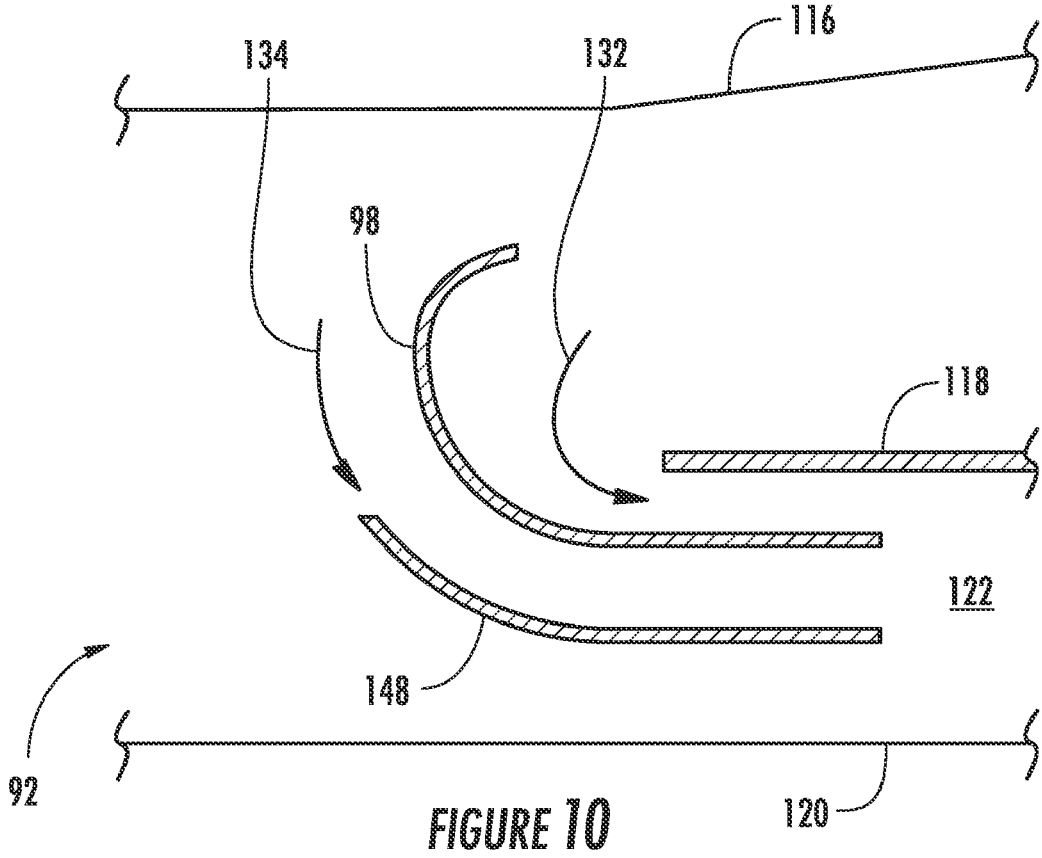
FIG. 10 is a simplified, partial cross-section of a fourth embodiment of a nozzle within the scope of the present invention.

FIGS. 8, 9, and 10 show simplified, partial cross-sections of alternate embodiments of nozzles 88, 90, 92 within scope of the present invention. Each figure shows an arcuate annular guide 94, 96, 98 in the context of a flow sleeve 100, 108, 116, a shroud 102, 110, 118, a center body 104, 112, 120, and an annular passage 106, 114, 122 as previously discussed with respect to FIG. 4. In each embodiment, the arcuate annular guide 94, 96, 98 divides the flow of compressed working fluid entering the annular passage 106, 114, 122 into a first airflow 124, 128, 132 and a second airflow 126, 130, 134. The first airflow 124, 128, 132 is between the arcuate annular guide 94, 96, 98 and the shroud 102, 110, 118, and the second airflow 126, 130, 134 is between the arcuate annular guide 94, 96, 98 and the center body 104, 112, 120.

In the embodiment shown in FIG. 8, an end 136 of the shroud 102 may include a section 138 having an increased thickness. The end 136 of the shroud 102 may be flat or rounded, as shown in FIG. 8. The rounded end 136 and/or thicker section 138 enhance the flow of the compressed working fluid through the first airflow 124 between the arcuate annular guide 94 and the shroud 102.

In the embodiment shown in FIG. 9, the arcuate annular guide 96 includes a first end 140 and a second end 142, and the second end 142 extends at least partially between the shroud 110 and the center body 112. The arcuate annular guide 96 further includes a center portion 144 between the first end 140 and the second end 142, and the center portion 144 has a larger thickness than at least one of the first end 140 or the second end 142. The center body 112 further includes a contoured surface 146. The combination of the thicker center portion 144 and contoured surface 146 of the center body 112 further enhances the radial and circumferential distribution of flow through the annular passage 114 by restricting the airflow through the second airflow 130, thereby increasing the airflow through the first airflow 128 and smoothing the first and second airflows circumferentially.

The embodiment shown in FIG. 10 further includes a baffle 148 between the arcuate annular guide 98 and the center body 120. The baffle 148 may be straight or curved, as shown in FIG. 10. The baffle 148 divides the second airflow 134 between the arcuate annular guide 98 and the center body 120 to further enhance the radial distribution of the airflow through the annular passage 122. The baffle 148 may exist entirely within the annular passage 122, as shown in FIG. 10. Alternately, the baffle 148 may begin radially outward of the shroud 118 and continue into the annular passage 122 between the shroud 118 and the center body 120.

Figure 11:
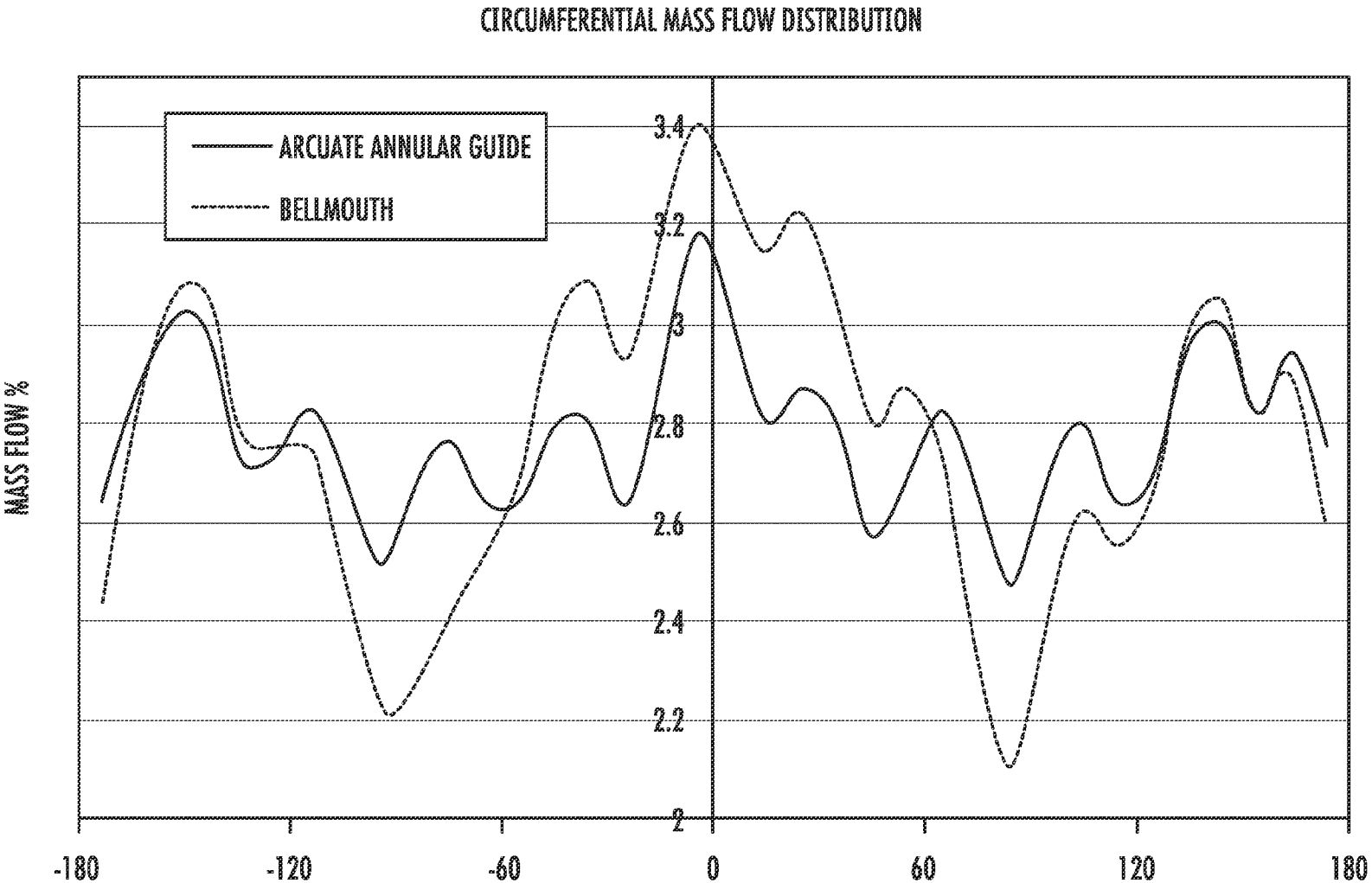
FIG. 11 is a graph of radial airflow through a bellmouth nozzle and through a nozzle within the scope of the present invention.
Figure 12:
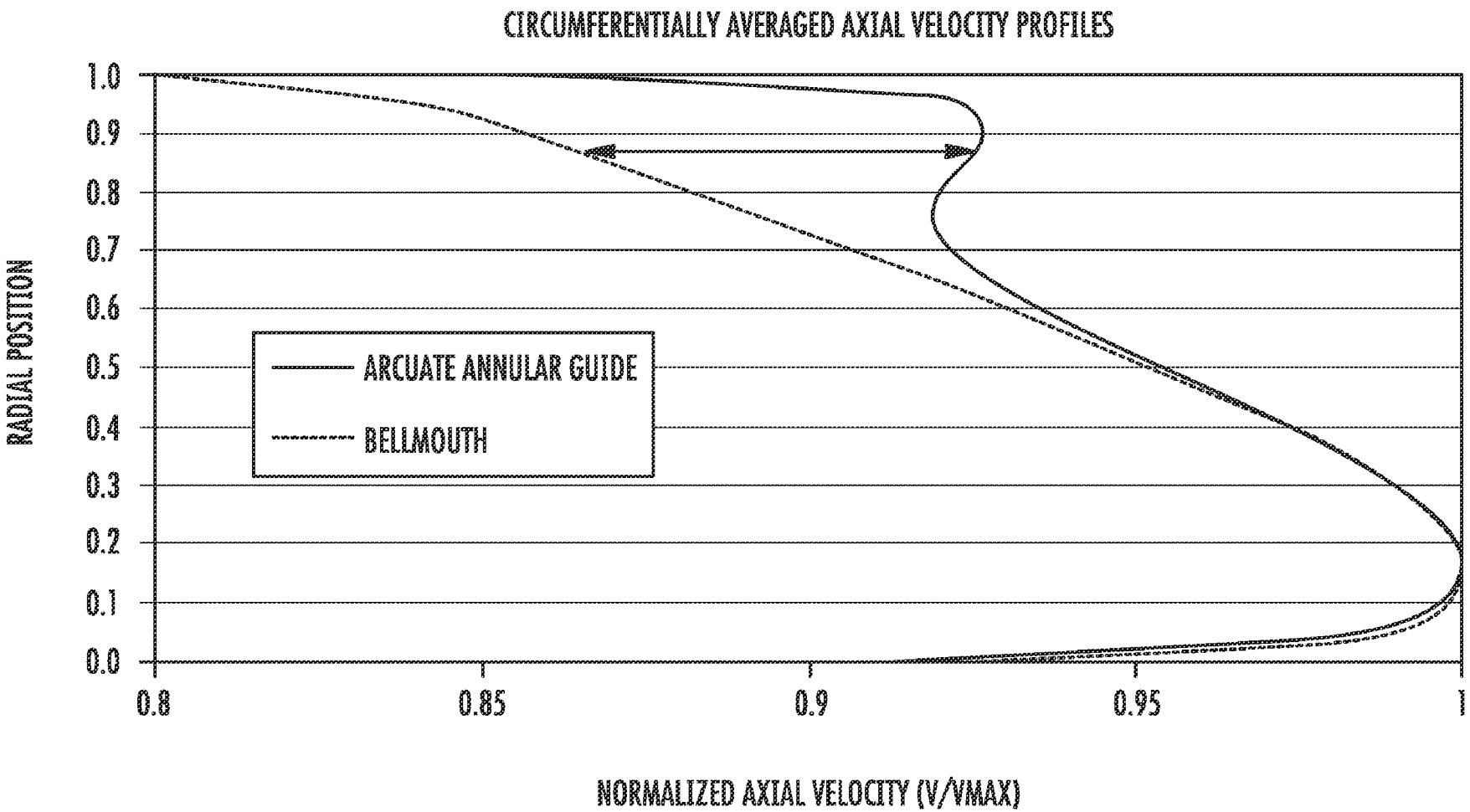
FIG. 12 is a graph of airflow velocity through a bellmouth nozzle and through a nozzle within the scope of the present invention.

FIGS. 11 and 12 graphically illustrate the airflow performance of a bellmouth nozzle compared to a nozzle within the scope of the present invention. For example, FIG. 11 shows the percentage of mass flow at each radial position for a bellmouth nozzle and a nozzle having an arcuate annular guide. A uniform radial airflow would produce a mass flow percent that is the same at each radial position, resulting in a horizontal line in the graph shown in FIG. 11. As shown, the mass flow percent varies more radially for the bellmouth nozzle than for the nozzle having an arcuate annular guide.

FIG. 12 illustrates the airflow velocity at different radial positions for a bellmouth nozzle and a nozzle having an arcuate annular guide. As shown in FIG. 12, the axial velocities for both nozzles is relatively similar at inner radial positions close to the axial centerline of the nozzles. However, the nozzle with an arcuate annular guide produces an improved axial velocity at outer radial positions closer to the shroud compared to the bellmouth nozzle. The arrow in FIG. 12 illustrates the improved axial velocity at the outer radial position for the nozzle having an arcuate annular guide compared to the bellmouth nozzle.

A nozzle constructed according to any of the embodiments shown in FIGS. 4 through 10 may further provide a method for conditioning airflow. According to this method, air flows along an exterior surface of the shroud until it is divided outside of the shroud into a first airflow and a second airflow. The first airflow is directed into an outer portion of the annular passage between the center body and the shroud. The second airflow is directed into an inner portion of the annular passage between the center body and the shroud. As shown in FIG. 9, the method may include narrowing or constricting the airflow in the annular passage between the center body and the shroud. Additionally, as shown in FIG. 10, the method may further include dividing the second airflow entering the annular passage.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fuel nozzle, comprising:

a. a center body of the fuel nozzle;

b. a shroud circumferentially surrounding at least a portion of the center body to define an annular passage between the center body and the shroud, wherein the shroud includes an end, swirler vanes extending from the center body to the shroud; and c. an arcuate annular guide separated from the end of the shroud and extending from a point radially inward of the end of the shroud to a point radially outward of the end of the shroud so that the arcuate annular guide defines a first airflow path between the arcuate annular guide and the shroud and a second airflow path between the arcuate annular guide and the center body.

2. The fuel nozzle of claim 1, wherein the arcuate annular guide includes a first end and a second end, and the second end extends at least partially between the shroud and the center body.

3. The fuel nozzle of claim 1, further including at least one strut connected to the arcuate annular guide to support the arcuate annular guide.

4. The fuel nozzle of claim 3, wherein the at least one strut connects to at least one of an end cover, an end cap, the center body, or a nozzle flange.

5. The fuel nozzle of claim 1, wherein the arcuate annular guide includes a radially outer perimeter with a substantially flat segment along at least a portion of the radially outer perimeter.

6. The fuel nozzle of claim 1, wherein the end of the shroud includes a section having an increased thickness.

7. The fuel nozzle of claim 1, wherein the arcuate annular guide includes a first end, a second end, and a center portion between the first end and the second end and having a larger thickness than at least one of the first end or the second end.

8. The fuel nozzle of claim 1, wherein the center body includes a contoured surface that narrows the annular passage between the center body and the shroud.

9. The fuel nozzle of claim 1, further including a baffle between the arcuate annular guide and the center body so that the baffle divides the second airflow between the arcuate annular guide and the center body.

10. A combustor, comprising:

a. an end cap; and b. a fuel nozzle disposed in the end cap, wherein the fuel nozzle includes:

i. a center body;

ii. a shroud circumferentially surrounding at least a portion of the center body to define an annular passage between the center body and the shroud, wherein the shroud includes an end and swirler vanes extending from the center body to the shroud; and iii. an arcuate annular guide separated from the end of the shroud and extending from a point radially inward of the end of the shroud to a point radially outward of the end of the shroud so that the arcuate annular guide defines a first airflow path between the arcuate annular guide and the shroud and a second airflow path between the arcuate annular guide and the center body.

11. The fuel nozzle of claim 10, wherein the arcuate annular guide includes a first end and a second end, and the second end extends at least partially between the shroud and the center body.

12. The fuel nozzle of claim 10, further including at least one strut connected to the arcuate annular guide to support the arcuate annular guide.

13. The fuel nozzle of claim 10, wherein the arcuate annular guide includes a radially outer perimeter with a substantially flat segment along at least a portion of the radially outer perimeter.

14. The fuel nozzle of claim 10, wherein the end of the shroud includes a section having an increased thickness.

15. The fuel nozzle of claim 10, wherein the arcuate annular guide includes a first end, a second end, and a center portion between the first end and the second end and having a larger thickness than at least one of the first end or the second end.

16. The fuel nozzle of claim 10, wherein the center body includes a contoured surface that narrows the annular passage between the center body and the shroud.

17. The fuel nozzle of claim 10, further including a baffle between the arcuate annular guide and the center body so that the baffle divides the second airflow between the arcuate annular guide and the center body.

18. A fuel nozzle, comprising:

a. a center body of the fuel nozzle;

b. a shroud circumferentially surrounding at least a portion of the center body to define an annular passage between the center body and the shroud, wherein the shroud includes an end, and swirler vanes extending from the center body to the shroud; and c. an arcuate annular guide separated from the end of the shroud and extending from a point radially inward of the end of the shroud to a point radially outward of the end of the shroud so that the arcuate annular guide defines a first airflow path between the arcuate annular guide and the shroud and a second airflow path between the arcuate annular guide and the center body.

19. The fuel nozzle of claim 18, wherein the arcuate annular guide includes a radially outer perimeter with a substantially flat segment along at least a portion of the radially outer perimeter.

20. The fuel nozzle of claim 18, wherein the arcuate annular guide includes a first end, a second end, and a center portion between the first end and the second end and having a larger thickness than at least one of the first end or the second end.

* * * * *